US008408553B2

(12) United States Patent
Eskildsen

(10) Patent No.: US 8,408,553 B2
(45) Date of Patent: Apr. 2, 2013

(54) GOAL DETECTOR FOR DETECTION OF AN OBJECT PASSING A GOAL PLANE

(75) Inventor: Jørn Eskildsen, Tørring (DK)

(73) Assignee: Fraunhofer-Gesellschaft zur Forderung der Angewandten Forschung E.V. (DE)

( * ) Notice: Subject to any disclaimer, the term of this patent is extended or adjusted under 35 U.S.C. 154(b) by 1486 days.

(21) Appl. No.: 11/908,241

(22) PCT Filed: Mar. 9, 2006

(86) PCT No.: PCT/DK2006/000136

§ 371 (c)(1),
(2), (4) Date: Nov. 14, 2007

(87) PCT Pub. No.: WO2006/094508

PCT Pub. Date: Sep. 14, 2006

(65) Prior Publication Data

US 2008/0252015 A1 Oct. 16, 2008

(30) Foreign Application Priority Data

Mar. 9, 2005 (DK) ..... 2005 00352

(51) Int. Cl.
*F41J 5/00* (2006.01)

(52) U.S. Cl. ..... 273/371; 473/470; 473/471

(58) Field of Classification Search ..... 473/471, 473/470; 273/371

See application file for complete search history.

(56) References Cited

U.S. PATENT DOCUMENTS

| | | | | |
|---|---|---|---|---|
| 4,375,289 | A | 3/1983 | Schmall et al. | |
| 4,675,816 | A | 6/1987 | Brandon et al. | |
| 4,973,952 | A * | 11/1990 | Malec et al. | 340/5.91 |
| 5,346,210 | A | 9/1994 | Utke et al. | |
| 5,509,649 | A | 4/1996 | Buhrkuhl | |
| 5,748,073 | A | 5/1998 | Crawford | |
| 5,971,931 | A | 10/1999 | Raff | |
| 5,976,038 | A | 11/1999 | Orenstein et al. | |
| 6,084,513 | A * | 7/2000 | Stoffer | 340/572.2 |
| 6,151,563 | A | 11/2000 | Marinelli | |
| 6,166,643 | A * | 12/2000 | Janning et al. | 340/573.3 |
| 6,396,438 | B1 * | 5/2002 | Seal | 342/127 |

FOREIGN PATENT DOCUMENTS

| | | |
|---|---|---|
| DE | 20 51 386 | 4/1972 |
| DE | 2051386 | 4/1972 |
| EP | 1 457 236 | 9/2004 |
| FR | 2 726 370 | 5/1996 |

(Continued)

OTHER PUBLICATIONS

European Search Report; EP 08 00 4064; Apr. 18, 2008.

(Continued)

*Primary Examiner* — Michael Cuff
(74) *Attorney, Agent, or Firm* — Cantor Colburn LLP

(57) ABSTRACT

A system is disclosed for detection of whether a movable object, such as a sports object, e.g. a football or an ice hockey puck, has passed goal plane. It is known to encircle the goal plane with conductors to produce an electromagnetic field to excite signal emitter means in the movable object, alternatively detect the signal emitted by the emitter means. With the present invention these circuits are sectioned into a plurality of separate circuits, which provides an improved spatial resolution of the system in particularly when the movable object is close to the conductors.

25 Claims, 4 Drawing Sheets

FOREIGN PATENT DOCUMENTS

| | | | | |
|---|---|---|---|---|
| FR | 2726370 | | | 5/1996 |
| FR | 2 753 633 | | | 3/1998 |
| FR | 2753633 | | | 3/1998 |
| GB | 2001250 | | | 1/1979 |
| JP | 08117362 | A | * | 5/1996 |
| JP | 2000271259 | A | | 10/2000 |
| JP | 2001-17599 | | | 1/2001 |
| JP | 2001017599 | | | 1/2001 |
| JP | 2001118018 | A | | 4/2001 |
| JP | 2005081128 | A | * | 3/2005 |
| WO | 97/38762 | | | 10/1997 |
| WO | 98/37932 | | | 9/1998 |
| WO | 99/34230 | | | 7/1999 |
| WO | 01/66201 | | | 9/2001 |
| WO | 2004/026411 | | | 4/2004 |
| WO | 2004067109 | A2 | | 8/2004 |
| WO | 2004/076003 | | | 9/2004 |
| WO | WO 2004076003 | A1 | * | 9/2004 |

OTHER PUBLICATIONS

International Search Report; PCT/DK2006/000136; Aug. 9, 2006.

* cited by examiner

GOAL DETECTOR FOR DETECTION OF AN OBJECT PASSING A GOAL PLANE

TECHNICAL FIELD OF THE INVENTION

The present invention relates to a system for detection of whether a movable object, such as a sports object, e.g. a football or an ice hockey puck, has passed a flat plane in space, such as a goal plane defined e.g. as a vertical plane extending from a goal line or a horizontal plane defined by the upper rim of the basketball basket.

BRIEF DESCRIPTION OF THE RELATED ART

Traditionally, the referee or referees of a sports match decides from visual observation whether or not the ball has passed the goal plane. However, this may be very difficult to determine correctly in situations where the ball is returned quickly and has only just passed, or not passed, the goal plane, and it is particularly difficult if the referee is positioned unsuitably with respect to the goal plane or is engaged in other activity of the match. Video camera may also be used to monitor the goal planes, but the spatial and temporal resolution of video-cameras are often not sufficient to provide the necessary information in cases of doubt.

A number of electronic systems are known in the art for determining the position of a ball on a sports field by means of position systems, as disclosed in e.g. WO 01/66201, FR 2 753 633, FR 2 726 370, WO 99/34230, U.S. Pat. No. 4,675,816, U.S. Pat. No. 5,346,210 and WO 98/37932. These positioning systems may be used e.g. for determining if the ball has passed the border of the playing field and the positions of the players as well and provides many useful information to the referee. However, the determination of the passage of the goal plane is a very delicate matter, both because it may be decisive for the outcome of the sports match and because the distances are small and the velocity of the object often very high, so that a position determining system to provide a reliable determination of whether the object has passed the goal plane must be very precise in the determination of the position and at the same time have a very high update rate of the position determination. The object may e.g. move with 72 km/h or up to 130 km/h, which equals 20 m/s and 36 m/s, respectively, which means that an update rate of 1/100 s will add an uncertainty of 20 cm or up to 36 cm, respectively, to the determined position, which is unacceptable with respect to determination of a goal in a sports match.

Position systems with a sufficiently precise determination of the position of a sports object and a sufficiently high update rate to provide reliable indications of the crossing of a goal plane, are very expensive to install and maintain. It is therefore desirable to provide an alternative system with a sufficient spatial as well as temporal resolution to provide reliable indications.

U.S. Pat. No. 5,976,038 discloses an apparatus for providing an output indication when a playing object crosses the play determinative line. The apparatus comprises a directional receiving antenna, such as a disk-reflector antenna and in particular a cassegrain antenna provided with dual, horizontally adjacent feeds, which are combined to provide sum and difference signals. The antenna is arranged outside the playing field and is directed along the play determinative line. In order to provide a sufficiently high spatial resolution due to the distance between the antenna and the playing object, the reflector of the antenna must have considerable dimensions. A reflector of 30 inch width, 76 cm, will provide a detection zone of 4 inch width, 10 cm, which together with other uncertainties of the system is acceptable for use with American football as the patent is directed at, but is unacceptable for many other sports games and a much larger reflector would be required.

U.S. Pat. No. 4,375,289 discloses two electrical conductors or emitter coils encircling or enclosing the goal plane in two vertical levels with a mutual distance in the direction perpendicular to the goal plane and emitting each an electromagnetic field by providing the two conductors with alternating current in counter-phase, so that the electromagnetic field perceivable at the object when passing the goal plane is zero at the mid-plane between the two levels due to destructive interference, and the passage of this mid-plane is determined from measurements of the field intensity at a sensor in the ball. The ball sensor employed is a passive unit that receives power from the electromagnetic field by induction of current in a coil or antennae of the sensor, and emits a signal accordingly, which is detected by a detection coil situated between the two conductors, and the direction of the passage may be detected as well by means of a phase comparison between a signal received from the ball sensor and the phases of the currents in the conductors. The system may also be designed reversely with respect to emitter and detection coils, so that one emitter coil is situated in the goal plane between two detection coils with corresponding operation of the system, so that the ball is detected to pass the goal plane when the detected signals in the two detection coils are equal.

However, this arrangement has the drawback that the spatial resolution is limited by the size of the ball as the coil of the sensor substantially encircles the ball diameter, which is of increasing importance with decreasing distance between the ball and the detection coil. This is not a major problem when detecting most scored goals when the ball clearly passes the goal plane, but in situations of doubt where the ball only just passes or do not pass the goal plane completely and the ball is close to the coils, the spatial resolution is not sufficient to decide with a satisfactory precision whether or not the goal has been scored.

Furthermore, the present inventor has discovered that the electromagnetic fields emitted from the emitter coils encircling the goal plane is distorted in the area close to the coils and in particular near the area where the horizontal and vertical parts of the coils meet and the plane where the destructive interference is highest and the combined field is zero may deviate several centimetres from the goal plane in these areas.

BRIEF SUMMARY OF THE INVENTION

The invention provides a system for detecting the passage of an object passing a goal plane with an improved precision.

With the present invention several technical features are provided, which each or in combination presents such improvement.

The stationary conductors disclosed in U.S. Pat. No. 4,375,289 enclosing the goal plane and producing the electromagnetic field that are used in order to detect the passage of the goal plane, alternatively detect the signal emitted by the sensors in the ball, may in an advantageous embodiment of the present invention be sectioned into a plurality of separate circuits. The problems relating to the spatial resolution of the system when the ball is close to the detecting coil may thereby be remedied by the ability of such system to separate detection data relating to different parts of the perimeter of the goal plane, so that data relating to the section closest to the passing ball may be disregarded in deciding whether the ball has passed the goal plane. This may e.g. be carried out by providing a distinct electromagnetic field from each of the sections so that the response from the sensors in the ball may be separated in the signal processing means of the system into responses on fields from the separate sections. In the embodiment where the sections are used as detectors, each section may e.g. provide a separate output to the signal processing means of the system and thereby enable an analysis where the near-field problems may be remedied. Furthermore, the system may be established without having to provide a closed electric circuit encircling the goal plane completely as shown in U.S. Pat. No. 4,375,289, i.e. that the sectioned system of conductors may be designed to operate without the presence of conductors in the ground under the goal line, which are inconvenient to establish and to connect to the conductors above the ground, in particular if the goal itself, to which the connectors above ground normally are fastened, needs to be moved. Also, the precise position of the moving object when passing the goal plane may be deduced from the output, which is very useful when animations of the scored (or not scored) goal are produced for direct television transmission of a sports game.

Thus, the present invention relates to a system comprising

- a movable object, e.g. a handball, a football or an ice hockey puck,
- radio wave emitter means arranged in the movable object, preferably in the form of a number of tuned antenna circuits,
- stationary exciter means arranged for exciting said radio wave emitter means, e.g. by emitting electromagnetic waves of a wavelength corresponding to the tuned circuits of the radio wave emitter means,
- stationary receiver means for receiving the radio waves from the radio wave emitter means and provide an output accordingly,
- a plurality of substantially closed first antenna circuits arranged along the periphery of a flat target plane, each first antenna circuit comprising two substantially parallel conductors extending substantially parallel to said periphery of the target plane, said parallel conductors being arranged with a mutual distance in the direction perpendicularly to the flat target plane, wherein said plurality of first antenna circuits constitutes one of said stationary exciter means and said stationary receiver means,
- the system further comprising processing means to receive and process said output together with a predetermined set of conditions and providing a resulting output if the set of conditions are fulfilled so as to determine whether the movable object passes the flat target plane.

By the term first antenna circuit is understood a closed loop of one or more conductors arranged along a path, preferably defined in a flat plane, so that the loop encloses an area. In a particularly preferred embodiment, the first antenna circuits are arranged each on a separate rigid structure, such as a plate structure.

When the term "along the periphery of the flat target plane" is used, it is understood that the antenna circuits are arranged close to or adjacent to the periphery, such as within 50 centimetres, preferably within 20 centimetres of the periphery as measured in the plane of the flat target plane and in the distance away from the target plane.

The target plane is generally the plane the middle of the movable objects, or more particularly of the radio wave emitter means must pass for the being regarded as having passed the target plane, i.e. that a goal is scored.

The substantially parallel conductors of each first antenna circuit are preferably arranged on each side of the flat target plane in substantially the same distance perpendicularly to the target plane.

The mutual distance in the direction perpendicularly to the flat target plane between the substantially parallel conductors of each first antenna circuit is preferably within the range of 15 to 50 centimetres, and the distance between the parallel conductors of each antenna circuit is preferably the same for all of the plurality of the antenna circuits of the system.

The length of the substantially parallel conductors of each first antenna circuit along the periphery of said flat target plane is preferably within the range of 0.5 to 3 meters, more preferably in the range of 1 to 2 meters.

At least some of the first antenna circuits, such as in the range of 4 to 16, preferably in the range of 6 to 12, are in a preferred embodiment of the present invention arranged in series along a substantially horizontal line of the flat target plane, in particular along a horizontal crossbar of a goal delimiting the flat target plane. The first antenna circuits are preferably arranged substantially equidistantly along the horizontal line of the flat target plane.

Likewise is it also preferred that at least some of the first antenna circuits are arranged in series along substantially vertical lines of the flat target plane, in particular vertical side posts of a goal delimiting the flat target plane. The number of first antenna circuits along each vertical line is preferably in the range of 2 to 8, most preferably in the range of 3 to 6. The first antenna circuits are preferably arranged substantially equidistantly along the vertical lines of the flat target plane.

The system may further comprise a second antenna circuit extending substantially at the periphery of the flat target plane and constituting the other of said stationary exciter means and said stationary receiver means, i.e. situated where the signal from the movable object is most crucial for determining the possible passage of the target plane. The second antenna circuit may extend somewhat outside the periphery in the direction parallel to the target plane as long as it extends substantially in the same plane as the target plane.

In a particularly preferred embodiment, the first antenna circuits constitute the stationary receiver means and the second antenna circuit constitutes the stationary exciter means. In this case, the output to the data processing means represents the voltage or current generated in each of the first antenna circuits. In a particularly preferred embodiment, the system comprises compensation means for each of the first antenna circuits for compensating of a possible misalignment of the first antenna circuit and the second antenna circuit during operation of the system. This misalignment would cause the second antenna circuit to generate a voltage or current in the first antenna circuit, a false signal, and the purpose of the compensation means is to reduce or eliminate such false signal in the first antenna circuit, whereby the signal-to-noise ratio of the first antenna circuit with respect to the radio wave emitter means in the moving object is improved. Furthermore, if this false signal is eliminated after calibration of the compensation means, a signal detected by a first antenna circuit and not originating from the radio wave emitter means in the moving object may be used to detect a possible error in the alignment of the plane of the first antenna circuit with a plane perpendicularly to the flat target plane in that such signal would origin either from the opposing part of the second antenna circuit extending parallel to the part of the second antenna circuit adjacent to the first antenna circuit or from a third calibration antenna extending in the same plane as the flat target plane but with a distance to the first antenna circuit away from the periphery of the flat target plane, so that the angular misalignment can be deduced. Such detected angular misalignment between the plane of the first antenna circuit with the plane perpendicularly to the flat target plane may be used to compensate the output from the first antenna circuit in question when determining whether or not the moving object is passing the target plane.

A signal detected by a first antenna circuit may upon analysis be determined to generated from electromagnetic waves from radio wave emitter means arranged in the movable object if those emitter means comprises a tuned circuit in that the phase angle of voltage or current generated by the waves from such circuit will be displaced about 90 degrees with respect to the alternating current of the exciter means.

The compensation means may be implemented in the signal processing means of the system or be constituted by a circuit connected to the first antenna circuit in question and feeding a compensating counter current to it. However, in a preferred embodiment, the first compensation means comprises a compensation loop arranged substantially in the plane of the first antenna circuit and displaced from the periphery of the flat target plane towards one of the parallel conductors. A suitable actuating current fed to the compensation loop will result in a cancelling of part of the electromagnetic field generated by the second antenna circuit and thus provide a compensation for the first antenna circuit being non-perpendicular to the flat target plane.

The detection of the crossing of the goal plane has to be made with a high degree of precision, which requires a high spatial resolution of the detection system which again requires a high temporal resolution as the ball often moves with a high velocity of the order of 20 m/s or even more such as 36 m/s According to another aspect, the ball applied in the present invention may be equipped with memory means, separate wireless transmission means and control means for controlling the memory means and the transmission means. The control means are arranged to sample the field intensity measured by the sensor with a given sample rate, e.g. 500 to 10,000 Hz, such as 4,000 Hz, and all sampled values are provided to the memory means operating as a FIFO (first in first out) memory, so that the latest sample replaces the oldest stored sample in the memory, whereby the newest samples of e.g. the last 0.5 seconds are stored in the memory means at any time where the sensor is powered by a battery or by induction from the electromagnetic field of the conductors.

Only when an indication of a passage of the goal plane is detected, the control means are arranged to perform a transmission of the entire set of samples stored in the memory means is performed. Such indication could be made from a preliminary analysis of the samples made by the individual sensor, from comparison of the detections made by a plurality of sensors arranged in the same ball, or a more coarse redundancy system, such as the one disclosed in U.S. Pat. No. 4,375,289. The transmitted data are received by a stationary receiver and analysed to determine whether the ball has passed the goal plane. Optionally, the control means are furthermore arranged to transmit a fraction of the measured samples of the field intensities only, such as 1/10 or 1/5 of the samples as a standard, constantly during sampling of the field intensities.

In this manner, a more detailed set of data representing the field intensity detected by the sensor may be provided to the stationary control unit for analysis as the sample rate of the field intensity detected by the sensor at the time of a possible passage of the goal plane may be many times higher than the data transmission rate. The data transmission rate depends on the selected transmission frequency and the available power for transmitting the data, and for a passive sensor, the available power is proportional to the area enclosed by the conductor of the sensor in which the power is inducted by the electromagnetic field. With the present embodiment of the sensor, a reliable transmission intensity, resulting in a suitable signal-to-noise ratio at the receiver, is made possible for a suitably high data sample rate of e.g. a factor of 10 times the reliable data transmission rate, and a small area enclosed by the conductor of the sensor, whereby the physical extend of the sensor allows for the provision of a plurality of sensors, such as four, six, eight or even more in a standard football or other standard balls for ball games.

In a particular embodiment, the control means of the sensor is arranged to transmit the data stored in the memory means in a sequence where the most relevant data is transmitted first, i.e. the data closest to a determined probable passing of the goal plane, e.g. the first sample after the passing, followed by the first sample before the passing, then the second sample after the passing etc. In a second embodiment, a sampling of lower frequency, e.g. every fifth or every tenth sample is transmitted first, after which the remaining data stored in the memory means are transmitted. Thereby, the chance of the most important data being received and processed by the stationary unit is improved.

Preferably, the data are transmitted from the sensor in digital form to further improve the signal-to-noise ratio of the received data signals from the sensor, and an advantageous transmission frequency is 27-35 MHz but other suitable frequencies such as 433 MHz, 868 MHz or 2.4 GHz may also be applied. The preferred frequencies employed are within the ranges that do not require a public license for use.

In most games, such as football (also known as "soccer") the whole ball must have passed the goal plane for a goal to be deemed scored, and a high spatial resolution of the detection of the ball passing the goal plane is thus desirable. With known sensors as shown in U.S. Pat. No. 4,375,289, the ball is encircled by three conductors arranged in intersecting, perpendicular planes passing through the centre of the ball. In each conductor, a current is inducted in proportion to the total electromagnetic flux through the area encircled by the conductor. The total electromagnetic flux through the area depends on the flux density and the angle between the direction of the electromagnetic flux vector and the area, but the variations of the angle is generally compensated by combining the induced currents in the three, perpendicular conductors. However, the flux density is integrated over an area the size of the cross sectional area of the ball and the combined induced current is thus a measure of the total flux passing the ball. The spatial resolution of the sensor is consequently limited by the size of the ball.

In order to improve the spatial resolution a plurality of sensors may be provided in the ball, preferably between the inner latex balloon of the ball and the outer shell thereof, but could alternatively be situated on the inside of the latex balloon. In one embodiment, each of the sensors or at least a part of the sensors are passive sensors comprising an antenna circuit or coil connected to a capacitor or the like to constitute a tuned circuit corresponding to the wavelength of the emitted electromagnetic field. In a second embodiment, the data of the field intensity measured by the individual sensors are transmitted to a stationary data processing unit for determination of the passage of the goal plane of each individual sensor. The compensation for the angle between the induction antenna of the individual sensor and the electromagnetic flux vector may then be made at the stationary data processing unit from the complete set of data from the plurality of sensors by solving a system of equations regarding the spatial and angular position of the ball. The important feature to determine is whether all sensors have passed the goal plane, which is not necessarily physically coincident with the mid-plane between the conductors encircling the goal plane.

It is advantageous for this data processing that the individual sensors in the ball are synchronised with respect to sampling of field intensity data by means of synchronisation means, which e.g. may be provided by interconnecting the sensors and providing a common synchronisation signal or alternatively by providing a synchronisation signal to the sensors by means of the current in the conductors providing the electromagnetic field. It would also be an advantage that the data transmission from the individual sensors are coordinated so that the data transmission does not interfere negatively, which may be provided by mutually connecting the sensors so that the individual data transmissions may be synchronised or by having one common data transmission means in the ball by which all data are transmitted to the stationary data processing unit. Alternatively, each sensor may have data transmission means arranged to transmit data to the stationary data processing unit at separate frequencies. Another advantageous feature would be for passive sensors to interconnect the power supplies of the individual sensors, so that each sensor will have sufficient power to obtain and transmit measured data of the field intensity regardless of the angle between the area spanned by the induction antennae of the individual sensor and the direction of the electromagnetic flux vector.

The ball may further comprise identification means for emitting a unique identification to the stationary data processing means for ensuring that the ball used in the game is certified to be used with the system according to the invention. Furthermore, calibration data and communication details for the individual ball may be transmitted.

The electromagnetic field intensity from the two coils shown in U.S. Pat. No. 4,375,289 with currents in counter-phase is lowest at the area where it is most crucial for the detection to have the most precise determination of the position of the ball sensor. Thus, the signal to be detected as well as the power provided for passive sensors by the electromagnetic field is lowest at this area and zero at the mid-plane which is situated at or close to the goal plane.

One solution according to an aspect of the present invention is providing the current source of one of the conductors with a fast phase shifting arrangement, so that the phase of the conductor may be switched between being in counter-phase and in phase with the other conductor with a switching rate of the order of magnitude of the sampling rate of the signal intensity detected at the ball, i.e. between 200 and 10,000 Hz, preferably in the range of 500 to 6,000 Hz, so that e.g. every second or third sample is made when the electromagnetic fields are in phase and the two fields at the mid-plane between the two conductors are in constructive interference and the field intensity has a maximum at that plane due to the configuration of the separate field intensities and the distance between the two conductors.

Thus, the provision of a high field intensity at the position of the mid-plane is an advantage when using passive ball sensors, i.e. sensors that are powered by the electromagnetic field provided by the conductors, because the available power for detection of the field intensity and transmitting data thereby is high, also for detection of the weak field intensities of the electromagnetic fields in counter-phase.

Furthermore, the position of the ball sensor with respect to the mid-plane may be detected with two different methods, from a determination of the passage of the zero field intensity as in the known technique when the currents are in counter-phase as well as from a determination of the maximum intensity when the currents are in phase. The first method provides an excellent overall indication of the passage of the mid-plane and possibly the direction of the passage, but has a weakness with respect to the details near the actual passage as the detected field intensity is very low in that area, whereas the second method has highest field intensity around the passage of the mid-plane and thus the most details, but the second method, in which a peak value of the filed intensity is detected, applied by itself has a high risk of erroneous passage detections as peak values may occur at other positions of the ball sensors than the mid-plane due to e.g. interference from the bodies of the players and from external sources of electromagnetic fields. A threshold value for the peak intensity may be applied for filtering the detected intensities, but it has only a limited effect because of the field intensity variation over the goal plane with at least an order of magnitude (i.e. a factor of 10).

However, by combining the second method with the first method, the risk of erroneous passage detections is in practice eliminated as an estimate of the correct passage position is provided by the first method and the combined method obtains the high spatial resolution of the second method.

A second solution is to provide the emitting coils with overlapping currents of different frequencies, so that current at a first frequency for supplying power is in phase at the two coils, so that the electromagnetic fields of this frequency are in constructive interference and current of a second frequency for providing a signal is supplied in counter-phase. The electromagnetic field of the first frequency may be used to supply the sensor or sensors in the ball with power at all positions during the passage of the goal plane. In this case, arrangements are to be made in the ball sensor to separate the effect of the two frequencies, such as employing separate resonance circuits for the frequencies.

Yet another solution is to provide the emitting coils with currents of only slightly different frequencies, so that the interference will produce an intensity varying at the mid-plane between zero intensity and a maximum intensity with a frequency equal to the difference in frequency between the two currents. The difference in frequency is preferably equal to an unequal multiple of the sample frequency of the sensor, such one or three times the sample frequency, so that power is induced in the coil of the sensor at all positions of the sensor and the intensity frequency may be used to synchronise the sample frequency in order for the sensor or sensors in the ball to detect the presence of zero intensity correctly.

Furthermore, it is within the present invention to address multiple sensors arranged in the same ball by means of emitting different overlapping frequencies for providing power and/signals to the individual sensor, so that the emitting coils e.g. may be used to select a subgroup of the sensors in the ball for measurement or that the individual sensors are addressed in sequence.

The frequency of the electromagnetic field provided by the two conductors is preferably within the range of 10 to 1,000 kHz, such as 50 to 500 kHz and most preferred within the range of 100 to 200 kHz, because electromagnetic fields in this range has practically no interaction with water molecules and therefore has no significant effect on the human bodies subjected to the field, and the disturbances of the field caused by the human bodies within the field are correspondingly reduced.

BRIEF DESCRIPTION OF THE FIGURES

Embodiments of the present invention are shown in the enclosed figures of which.

The figures are illustrations of embodiments of the present invention and are not to be regarded as limiting to the scope of the invention as presented herein.

DETAILED DESCRIPTION OF EMBODIMENTS OF THE INVENTION

Figure 1:
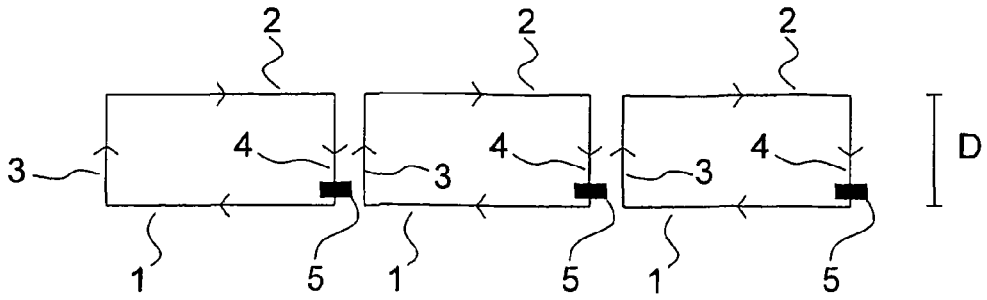
FIG. 1 shows three sections of a first embodiment of the present invention arranged along the cross bar of a goal.
Figure 2:
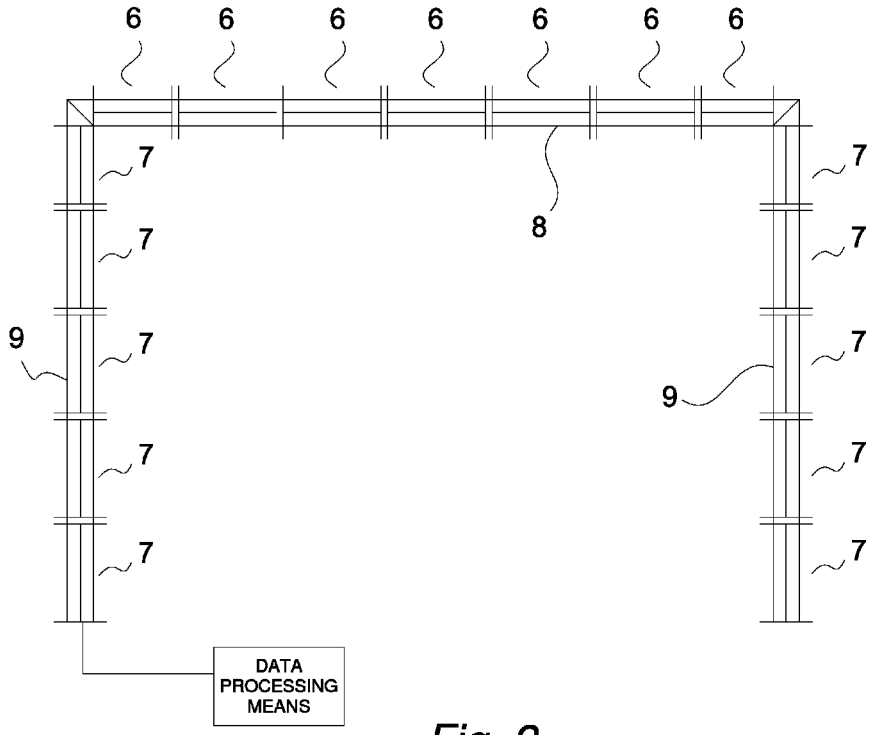
FIG. 2 shows a goal with sections according to the first or the second embodiment arranged along the perimeter of the goal plane.

In FIG. 1, three sections of the cross bar of a football goal are shown schematically as seen from above. Each section comprises a conductor 1 in a first plane and a parallel conductor 2 in a second plane and two intermediate conductors 3, 4 connecting the other conductors 1, 2 to form a circuit wherein a current may run as indicated by the arrowheads. Each section has a separate control unit 5 for feeding current into the circuit of the section and possibly obtain data relating to objects in which a power is inducted by the section. The distance D between the parallel conductors 1, 2 in the horizontal direction normal to the goal plane is preferably chosen to be about the diameter of a standard football according to the regulations set by FIFA, more generally speaking from 15 to 50 centimetres. In a specific embodiment, the parallel conductors 1, 2 in the same plane of adjacent sections may be electrically connected, so that the front conductor 1 of one section is connected to the front conductor 1 of the adjacent section etc. In FIG. 2, the goal is shown as seen from above with seven sections 6 distributed along the cross bar 8 and 5 section 7 along each side post 9 of the goal.

The number of sections may be e.g. 2 to 20 along the cross bar of the goal, such as 4 to 16 and preferably 6 to 12, and 2 to 8 sections along each side post of the goal, such as 3 to 6 sections. The length of each section is in a preferred embodiment within the range from 0.5 meters to 3 meters, such as 1 to 2 meters.

Each section may be controlled easily and fast, e.g. for fast switching of the phase or overlaying currents of different frequency as discussed in the previous section. Furthermore, the individual section may be controlled separately by common or by separate control means, so that more detailed information about the position of a passing ball may be obtained, either from the control means of the sections, the electromagnetic fields of which are influenced by the passing ball 20, or by varying the emitted electromagnetic fields from the individual sections, so that the data obtained by a sensor 25 or sensors 25 and 26 in the ball may carry such positional information. The electromagnetic field of each section may have an individual identity, e.g. by overlaying the current with a current of a distinct frequency so that the data returned from the sensor or sensors of the ball may carry information about their position with respect to the sections, so that a position of the sensor may be determined by the stationary data processing means for determination of passage of the goal plane with correction for the possible distortion of the electromagnetic field as discussed previously. Also or as an alternative, the individual sections may be turned on and off rapidly to determine from which section or sections the electromagnetic field detected by the sensor or sensors origins. Furthermore, the sections may be used to test whether the system operates correctly by emitting an electromagnetic field outside the range detected by the sensor or sensors and record and evaluate the possible response from the system. The possible response may be employed to adjust a compensation algorithm in the data processing means of the system.

Figure 3:
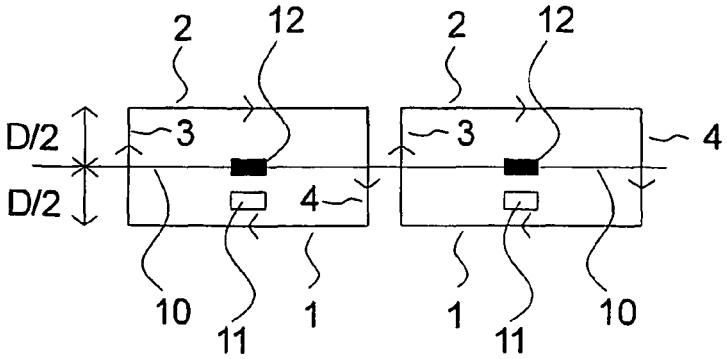
FIG. 3 shows two section of a second embodiment of the present invention.
Figure 4:
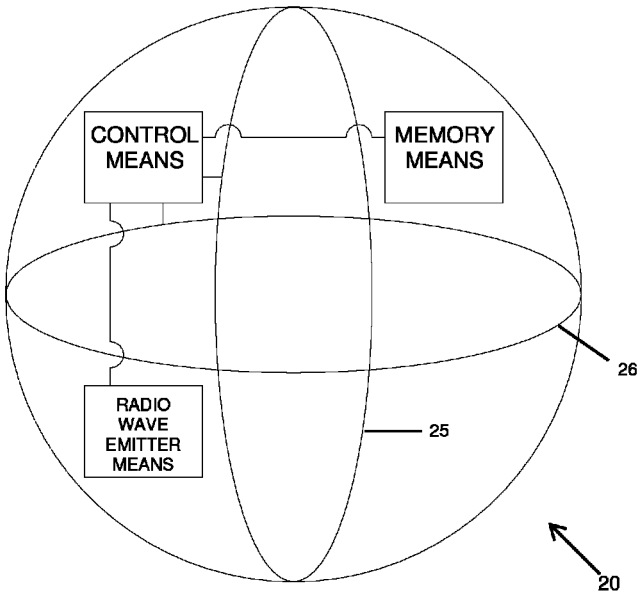
FIG. 4 shows a movable object in the form of a ball having a control means, a sensor means, a memory means, and a radio wave emitter means.

The second embodiment of the section as shown in FIG. 3, the first antenna circuits constitute the stationary receiver means and the second antenna circuit 10 arranged at the circumference of the goal plane constitutes the stationary exciter means that provides an electromagnetic field with a frequency of about 125 kHz, which corresponds to the frequency to which the passive sensor and radio wave emitter means in the ball are tuned to. The parallel conductors 1, 2 of each section are arranged with substantially the same distance D/2 in the direction perpendicularly to the goal plane from the second antenna circuit 10 so that the total current generated in the conductor 1, 2, 3, 4 circuit of the section ideally is zero when the ball is not near the section. However, the alignment of the parallel conductors 1, 2 and the second antenna circuit 10 is not necessarily perfect, so that a "false" current is generated in the section's conductors 1, 2, 3, 4. In order to compensate for this, each section is provided with a compensation circuit 11 arranged asymmetrically within the circuit of the section with respect to the second antenna circuit 10 and control means (not shown) of the compensation circuit 11 are adjusted to provide a current to the circuit 11 during operation of the system so that the current in the section's conductors is zero when not influenced by the ball. Each section has a pick-up unit 12 arranged around the second antenna circuit in order to facilitate the calibration of the individual section independently of other features of the system.

Each section has output means (not shown) for outputting a measure of the electromagnetic field from the ball as detected by the current generated in the section's circuit of conductors 1, 2, 3, 4 to control means (not shown) of the system. From the input from all of the sectors, the possible passage of the ball through the goal plane may be determined with a high precision as disturbed output from one section, e.g. due to the ball passing close to the section or due to malfunction of a section, may be neglected by the control means. Due to the fact that the possible misalignment between the conductors 1, 2, 3, 4 of the section and the second antenna circuit 10 are measured and compensated, the occurrence of a generated current in the section's conductors will be an indication of a angular error of the section, i.e. that the section is oriented non-perpendicular to the flat goal plane. Such generated current is easily separated from currents generated by the sensors in the ball as they are tuned and their phase is displaced 90 degrees with respect to the current in the second antenna circuit 10, whereas the current generated in the section's conductors directly by the second antenna circuit 10 arranged along the opposite side of the goal plane will be in phase with the current in the second antenna circuit 10. Thus, the detection provided by the section may be corrected for the angular error.

The frequency of the electromagnetic field provided by the section is preferably within the range of 10 to 1,000 kHz, such as 50 to 500 kHz and most preferred within the range of 100 to 200 kHz, because electromagnetic fields in this range has practically no interaction with water molecules and therefore has no significant effect on the human bodies subjected to the field, and the disturbances of the field disturbances caused by the human bodies within the field are correspondingly reduced.

The invention claimed is:

1. A system comprising a movable object, radio wave emitter means arranged in the movable object, stationary exciter means arranged for exciting said radio wave emitter means, stationary receiver means for receiving radio waves from the radio wave emitter means and for providing an output accordingly, a plurality of substantially closed first antenna circuits arranged along a periphery of a flat target plane, each of the plurality of substantially closed first antenna circuit comprising two substantially parallel conductors extending substantially parallel to said periphery of the target plane, one of the two substantially parallel conductors being arranged on a first side of the flat target plane and the other of the two conductors being arranged on a second opposing side of the flat target plane, each of the two substantially parallel conductors being arranged a substantially similar distance in a direction perpendicularly to the flat target plane, wherein said plurality of first antenna circuits constitutes one of said stationary exciter means and said stationary receiver means, and data processing means to receive and process said output together with a predetermined set of conditions and providing a resulting output if the set of conditions are fulfilled so as to determine whether the movable object passes the flat target plane.

2. A system according to claim 1, wherein the substantially parallel conductors of each first antenna circuit are arranged on each side of the flat target plane substantially the same distance perpendicularly to the target plane.

3. A system according to claim 1, wherein the mutual distance in the direction perpendicularly to the flat target plane between the substantially parallel conductors of each first antenna circuit is within the range of 15 to 50 centimeters.

4. A system according to claim 1, wherein said substantially parallel conductors of each first antenna circuit extend in the range of 0.5 to 3 meters along the periphery of said flat target plane.

5. A system according to claim 1, wherein at least some of the first antenna circuits are arranged in series along a substantially horizontal line of the flat target plane.

6. A system according to claim 5, wherein in the range of 4 to 16 of said first antenna circuits are arranged along the horizontal line of the flat target plane.

7. A system according to claim 6, wherein said first antenna circuits are arranged substantially equidistantly along the horizontal line of the flat target plane.

8. A system according to claim 5, wherein the horizontal line follows a horizontal crossbar of a goal delimiting the flat target plane.

9. A system according to claim 1, wherein at least some of the first antenna circuits are arranged in series along substantially vertical lines of the flat target plane.

10. A system according to claim 9, wherein in the range of 2 to 8 of said first antenna circuits are arranged along each of said vertical lines of the flat target plane.

11. A system according to claim 10, wherein said first antenna circuits are arranged substantially equidistantly along the vertical lines of the flat target plane.

12. A system according to claim 9, wherein the vertical lines follow vertical side posts of a goal delimiting the flat target plane.

13. A system according to claim 1, further comprising control means for controlling an operation of each of the first antenna circuits separately.

14. A system according to claim 1, further comprising a second antenna circuit extending substantially at the periphery of the flat target plane and constituting the other of said stationary exciter means and said stationary receiver means.

15. A system according to claim 14, wherein the first antenna circuit constitute the stationary receiver means and the second antenna circuit constitutes the stationary exciter means.

16. A system according to claim 15, further comprising first compensation means for each of the first antenna circuits, which are arranged to compensate during operation of the system for a possible misalignment of the first antenna circuit and the second antenna circuit.

17. A system according to claim 16, wherein the first compensation means comprises a compensation loop arranged substantially in a plane of the first antenna circuit and displaced from the periphery of the flat target plane towards one of the parallel conductors.

18. A system according to claim 1, wherein the movable object comprises:

sensor means for sensing an electromagnetic field, memory means, and control means for controlling the operation of the memory means and the radio wave emitter means, the control means being arranged to sample an electromagnetic field intensity measured by the sensor means with a given sample rate and store all sampled values to the memory means, the control means further being arranged upon activation to retrieve stored sampled values from the memory means and transmit said retrieved values by means of the radio wave emitter means.

19. A system according to claim 18, wherein said memory means are arranged to operate as first-in-first-out (FIFO) memory, so that a latest sample replaces an oldest stored sample in the memory.

20. A system according to claim 19, wherein the memory means during operation of the object is able to store values sampled with the given sample rate within a period of time of at least 0.2 seconds.

21. A system according to claim 18, wherein the given sample rate is in the range from 500 Hz to 10,000 Hz.

22. A system according to claim 1, wherein the movable object comprises:

a plurality of sensor means for sensing an electromagnetic field, memory means, and control means for controlling the operation of the memory means and the radio wave emitter means, the control means being arranged to sample an electromagnetic field intensity measured by the sensor means and transmit data relating to the field intensity measured by the individual sensors by means of said radio wave emitter means, wherein the transmitted data allow for a unique identification of which of said plurality of sensor means measured the transmitted data.

23. A system according to claim 22, comprising synchronisation means for synchronising the sampling of the individual sensor means.

24. A system according to claim 22, wherein each sensor means has individual radio wave emitter means.

25. A system according to claim 22, wherein the number of sensor means is at least 6.

* * * * *

UNITED STATES PATENT AND TRADEMARK OFFICE

CERTIFICATE OF CORRECTION

PATENT NO. : 8,408,553 B2
APPLICATION NO. : 11/908241
DATED : April 2, 2013
INVENTOR(S) : Jørn Eskildsen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1552 days.

Signed and Sealed this
First Day of September, 2015

Michelle K. Lee

Michelle K. Lee
*Director of the United States Patent and Trademark Office*